US009593466B2

(12) United States Patent
Magaki et al.

(10) Patent No.: US 9,593,466 B2
(45) Date of Patent: Mar. 14, 2017

(54) HYDRAULIC SHOVEL AND METHOD OF CONTROLLING HYDRAULIC SHOVEL

(75) Inventors: Hideto Magaki, Chiba (JP); Ryuji Shiratani, Chiba (JP); Jitsutaka Takeo, Chiba (JP)

(73) Assignee: SUMITOMO(S.H.I.) CONSTRUCTION MACHINERY CO., LTD., Tokyo (JP)

( * ) Notice: Subject to any disclaimer, the term of this patent is extended or adjusted under 35 U.S.C. 154(b) by 362 days.

(21) Appl. No.: 13/433,505

(22) Filed: Mar. 29, 2012

(65) Prior Publication Data

US 2012/0246981 A1 Oct. 4, 2012

(30) Foreign Application Priority Data

Mar. 31, 2011 (JP) ..... 2011-080728

(51) Int. Cl.
*E02F 9/22* (2006.01)
*E02F 9/20* (2006.01)

(52) U.S. Cl.
CPC ..... *E02F 9/2246* (2013.01); *E02F 9/2075* (2013.01); *E02F 9/2285* (2013.01)

(58) Field of Classification Search
CPC ..... E02F 9/20; E02F 9/2025; E02F 9/2041; E02F 9/2203; E02F 9/2221; E02F 9/2029; E02F 9/22; E02F 9/2214; E02F 9/2228
USPC ..... 701/50; 37/443
See application file for complete search history.

(56) References Cited

U.S. PATENT DOCUMENTS 4,537,029 A * 8/1985 Gunda ..... E02F 9/2217 60/390
5,048,293 A * 9/1991 Aoyagi ..... E02F 9/2235 60/420
5,062,350 A * 11/1991 Tanaka ..... E02F 9/2228 414/699
5,845,223 A * 12/1998 Song ..... E02F 9/2203 37/234
5,950,430 A * 9/1999 Tohji ..... E02F 9/123 60/426
6,050,090 A * 4/2000 Tohji ..... E02F 9/2203 60/421
6,233,511 B1 * 5/2001 Berger et al. ..... 701/50
6,234,254 B1 * 5/2001 Dietz ..... A01B 67/00 172/3
6,820,356 B2 * 11/2004 Naruse et al. ..... 37/348
6,851,207 B2 * 2/2005 Yoshimatsu ..... E02F 9/2075 37/348
7,669,413 B2 * 3/2010 Komiyama et al. ..... 60/414

(Continued)

FOREIGN PATENT DOCUMENTS

EP 1834854 9/2007
EP 1914102 4/2008

(Continued)

*Primary Examiner* — Robert Pezzuto
*Assistant Examiner* — Jessica H Lutz
(74) *Attorney, Agent, or Firm* — IPUSA, PLLC

(57) ABSTRACT

A hydraulic shovel includes an engine; a hydraulic pump driven by the engine; an excavating attachment which is driven by high oil discharged from the hydraulic pump; a motor generator that assists a power supply of the engine; and an assist control unit that controls the motor generator to assist the engine in a latter part of the excavating operation by the excavating attachment.

18 Claims, 9 Drawing Sheets

(56) References Cited

U.S. PATENT DOCUMENTS 8,190,334 B2 * 5/2012 Kagoshima et al. ..... 701/50
8,286,741 B2 * 10/2012 Kawashima ..... 180/65.285
8,437,923 B2 * 5/2013 Sano et al. ..... 701/50
8,473,165 B2 * 6/2013 Shono et al. ..... 701/50
8,504,251 B2 * 8/2013 Murota ..... 701/50
2002/0125052 A1 9/2002 Naruse et al.
2002/0148144 A1 * 10/2002 Tokunaga ..... B60K 6/442 37/348
2003/0221339 A1 * 12/2003 Naruse ..... E02F 9/2217 37/348
2003/0226291 A1 12/2003 Naruse et al.
2004/0020082 A1 * 2/2004 Ariga ..... E02F 9/2232 37/236
2004/0088103 A1 * 5/2004 Itow ..... B60K 6/485 701/110
2006/0085116 A1 * 4/2006 Suzuki et al. ..... 701/50
2006/0090461 A1 * 5/2006 Yoshino ..... E02F 9/2207 60/468
2006/0099081 A1 * 5/2006 Toda ..... E02F 9/2235 417/1
2006/0276948 A1 * 12/2006 Toda ..... 701/50
2007/0101708 A1 * 5/2007 Ohigashi ..... E02F 9/2235 60/431
2008/0104953 A1 * 5/2008 Vigholm ..... E02F 9/2217 60/413
2009/0057040 A1 * 3/2009 Yamada ..... B62D 11/001 180/6.48
2010/0031650 A1 * 2/2010 Morinaga ..... B60L 1/003 60/459
2010/0262353 A1 * 10/2010 Hyodo ..... B60W 10/06 701/102
2010/0270095 A1 * 10/2010 Shono ..... E02F 9/2246 180/65.29
2010/0312437 A1 * 12/2010 Saito ..... 701/50
2011/0004378 A1 * 1/2011 Saito ..... B60W 10/08 701/50
2011/0004379 A1 * 1/2011 Murota ..... 701/50
2011/0010059 A1 * 1/2011 Suzuki et al. ..... 701/50
2011/0040459 A1 * 2/2011 Takiguchi et al. ..... 701/50
2011/0264337 A1 * 10/2011 Takanashi et al. ..... 701/50
2012/0035815 A1 * 2/2012 Kawashima et al. ..... 701/50
2012/0253610 A1 * 10/2012 Anders et al. ..... 701/50
2013/0004281 A1 * 1/2013 Anders et al. ..... 414/687
2013/0282241 A1 * 10/2013 Sugiyama ..... 701/50
2013/0289834 A1 * 10/2013 Park et al. ..... 701/50
2013/0311052 A1 * 11/2013 Edamura et al. ..... 701/50
2013/0325269 A1 * 12/2013 Izumi et al. ..... 701/50

FOREIGN PATENT DOCUMENTS

EP 2267230 12/2010
EP 2270285 1/2011
JP 09-224354 8/1997
JP 2001-173024 6/2001
JP 2002-275945 9/2002
JP 2003-028071 1/2003
JP 2004-011502 1/2004
JP 2005-083242 3/2005
JP 2009-138495 6/2009
JP 2009-174446 8/2009
JP 2009-174447 8/2009
JP 2010-255824 11/2010
WO WO2009/157511 12/2009

* cited by examiner

HYDRAULIC SHOVEL AND METHOD OF CONTROLLING HYDRAULIC SHOVEL

BACKGROUND OF THE INVENTION

1. Field of the Invention

The present invention relates to a hydraulic shovel and a method of controlling a hydraulic shovel and more specifically, to a hydraulic shovel including an excavating attachment and a motor generator that assists a power supply of an engine and a method of controlling the hydraulic shovel.

2. Description of the Related Art

A hybrid shovel including an excavating attachment, an engine, a hydraulic pump driven by the engine, a hydraulic actuator driven by high pressure oil discharged from the hydraulic pump for driving the excavating attachment, and a motor generator capable of performing an assist drive operation and a power generation operation, is known (Patent Document 1).

In the hybrid shovel, a target engine speed, different from the current engine speed, is determined based on a load applied to the engine by the hydraulic pump, and the motor generator is operated to achieve the target engine speed by performing the assist drive operation or the power generation operation.

According to the hybrid shovel disclosed in Patent Document 1, with this operation, the specific fuel consumption (SFC) is improved not only at the case when the load applied to the engine by the hydraulic pump is low, but also in the case when the load applied to the engine by the hydraulic pump is large.

PATENT DOCUMENT

[Patent Document 1] WO2009/157511

However, for the hybrid shovel disclosed in Patent Document 1, the motor generator is operated to perform the assist drive operation after the load applied to the engine by the hydraulic pump becomes larger to a certain extent so that the movement of the excavating attachment becomes temporarily slowed down in an excavating operation to cause an operator to feel a rough operation.

SUMMARY OF THE INVENTION

The present invention is made in light of the above problems, and provides a hydraulic shovel capable of smoothing a movement of an excavating attachment in an excavating operation.

According to an embodiment, there is provided a hydraulic shovel including an engine; a hydraulic pump driven by the engine; an excavating attachment which is driven by oil discharged from the hydraulic pump; a motor generator that assists a power supply of the engine; and an assist control unit that controls the motor generator to assist the engine in a latter part of an excavating operation of the excavating attachment.

According to another embodiment, there is provided a method of controlling a hydraulic shovel including an engine, a hydraulic pump driven by the engine, an excavating attachment which is driven by oil discharged from the hydraulic pump, and a motor generator that assists a power supply of the engine, including controlling the motor generator to assist the engine in a latter part of an excavating operation of the excavating attachment.

BRIEF DESCRIPTION OF THE DRAWINGS

Other objects, features and advantages of the present invention will become more apparent from the following detailed description when read in conjunction with the accompanying drawings.

DETAILED DESCRIPTION OF THE PREFERRED EMBODIMENTS

Figure 1:
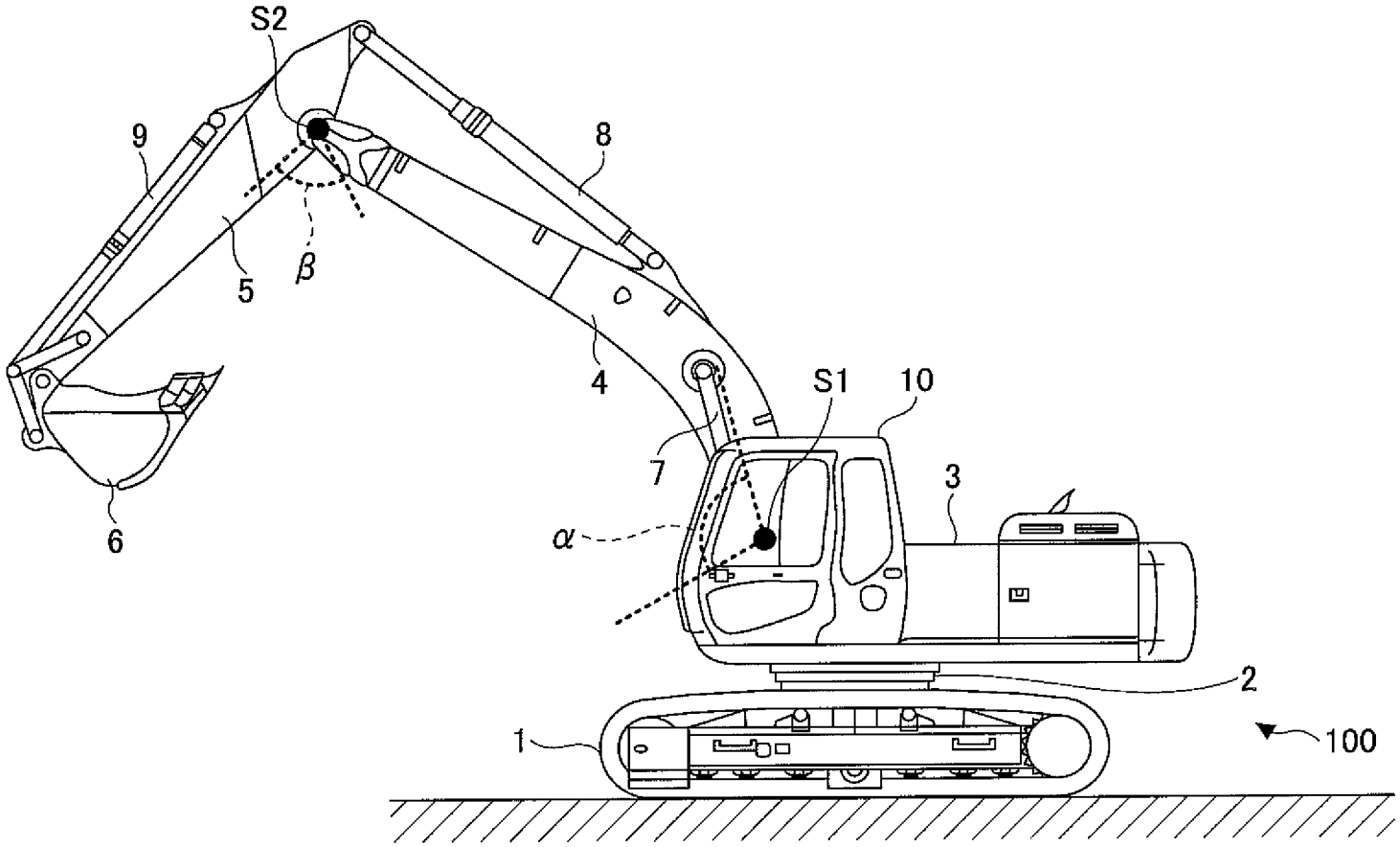
FIG. 1 is an elevation view showing an example of a hydraulic shovel of an embodiment.

The invention will be described herein with reference to illustrative embodiments. Those skilled in the art will recognize that many alternative embodiments can be accomplished using the teachings of the present invention and that the invention is not limited to the embodiments illustrated for explanatory purposes.

It is to be noted that, in the explanation of the drawings, the same components are given the same reference numerals, and explanations are not repeated.

First Embodiment

FIG. 1 is an elevation view showing an example of a hydraulic shovel 100 of an embodiment.

The hydraulic shovel 100 includes a traveling lower body 1, a slewing mechanism 2, a slewing upper body 3, a boom 4, an arm 5, a bucket 6, a boom cylinder 7, an arm cylinder 8, and a bucket cylinder 9.

In this embodiment, the traveling lower body 1 is a crawler type. The slewing upper body 3 is mounted on the traveling lower body 1 via the slewing mechanism 2 while being capable of being slewed by the slewing mechanism 2. The slewing upper body 3 is provided with a cabin 10 near which a power source such as an engine or the like is mounted.

One end of the boom 4 is attached to the slewing upper body 3. One end of the arm 5 is attached to the other end of the boom 4. The bucket 6 as an end attachment is attached to the other end of the arm 5. The boom 4, the arm 5 and the bucket 6 compose an excavating attachment. Further, the boom 4, the arm 5 and the bucket 6 are hydraulically driven by the boom cylinder 7, the arm cylinder 8 and the bucket cylinder 9, respectively.

The boom 4 is rotatably connected to the slewing upper body 3 in an upward direction and in a downward direction by a rotating supporter (joint). Further, a boom angle sensor S1 (a boom operation status detection unit) is attached to the rotating supporter. The boom angle sensor S1 detects a boom angle α (an upward angle from the state where the boom 4 is moved downward at most), which is an inclination angle of the boom 4.

The arm 5 is rotatably connected to the boom 4 by a rotating supporter (joint). Further, an arm angle sensor S2 (arm operation status detection unit) is attached to the rotating supporter. The arm angle sensor S2 detects an arm angle β (an angle from the state where the arm 5 is closed at the maximum), which is an inclination angle of the arm 5. When the arm 5 is opened to its maximum, the value for the arm angle β also reaches its maximum.

The operation of the hydraulic shovel 100 is explained with reference to FIG. 2A to FIG. 2G. FIG. 2A to FIG. 2G are illustrative views showing the operation of the hydraulic shovel 100.

Figure 2A:
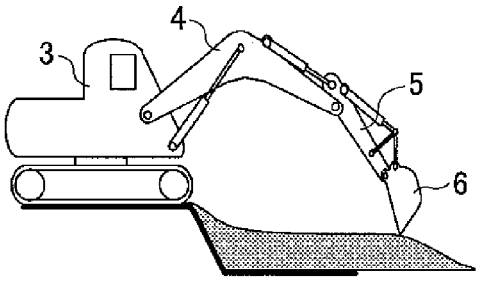
FIG. 2A to FIG. 2G are illustrative views showing the operation of the hydraulic shovel.

(Boom Down Swiveling Operation: FIG. 2A)

First, as shown in FIG. 2A, the slewing upper body 3 is swiveled so that the bucket 6 is positioned above a predetermined excavating position. Then, an operator moves the boom 4 downward while having the arm 5 and the bucket 6 being opened until the front end of the bucket 6 is positioned at a predetermined height from an object to be excavated. The operations of swiveling the slewing upper body 3 and moving the boom 4 downward are performed by an operator. The position of the bucket 6 is determined by the operator. Further, generally, the operations of swiveling the slewing upper body 3 and moving the boom 4 downward are performed at the same time.

These operations are hereinafter referred to as a "boom down swiveling operation" and a period for the boom down swiveling operation is referred to as a "boom down swiveling operation period".

Figure 2B:
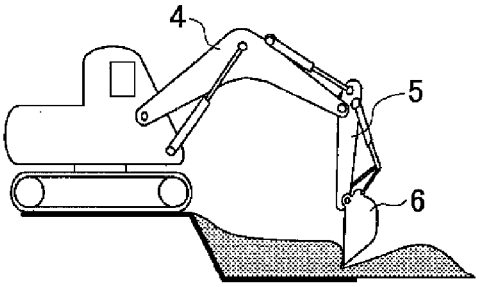

(First Excavating Operation: FIG. 2B)

When the operator determines that the front end of the bucket 6 is positioned at the predetermined height, as shown in FIG. 2B, a "first excavating operation" is performed. In the first excavating operation, which is a first part of an excavating operation, the arm 5 is closed until the extending direction of the arm 5 becomes substantially orthogonal to the ground. By the first excavating operation, mud of a predetermined depth is excavated and gathered until the extending direction of the arm 5 becomes substantially orthogonal to the ground.

Figure 2C:
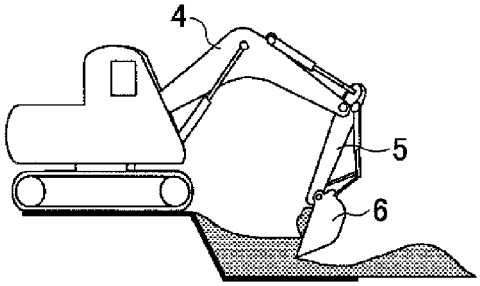
Figure 2D:
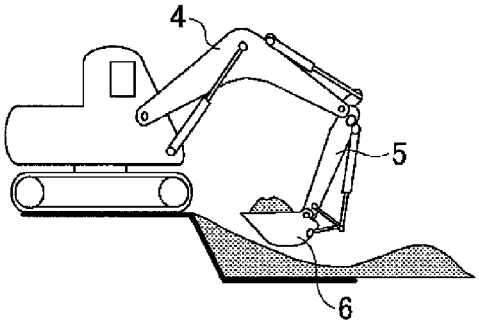

(Second Excavating Operation: FIG. 2C, FIG. 2D)

When the first excavating operation is completed, then, as shown in FIG. 2C, the arm 5 and the bucket 6 are further closed and then the bucket 6 is closed with respect to the arm 5 so that an upper edge of the bucket 6 is substantially orthogonal to the arm 5 as shown in FIG. 2D. This means that the bucket 6 is closed such that the upper edge of the bucket 6 becomes substantially parallel to a horizontal direction to contain the gathered mud or the like therein.

This operation, which is a latter part of the excavating operation, is referred to as a "second excavating operation", and a period for the second excavating operation is referred to as a "second excavating operation period".

Figure 2E:
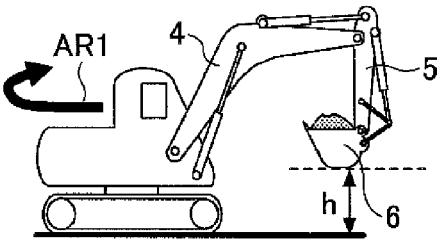

(Boom Up Swiveling Operation: FIG. 2E)

The operator determines that the bucket 6 is closed until the upper edge of the bucket 6 becomes substantially orthogonal to the extending direction of the arm 5; then, as shown in FIG. 2E, the boom 4 is moved up, while the bucket 6 remains closed, to a position where the bottom of the bucket 6 is positioned at a predetermined height "h".

Subsequently or at the same time, the slewing upper body 3 is swiveled as shown by an arrow AR1 such that the bucket 6 is moved to a position where the mud is ejected from the bucket 6.

These operations are referred to as a "boom up swiveling operation" and a period for the boom up swiveling operation is referred to as a "boom up swiveling operation period", hereinafter.

The predetermined height "h" may be set higher than a height of a carrier of a dump-truck so that the bucket 6 is not hit by the carrier when the mud scooped by the bucket 6 is ejected on the carrier.

Figure 2F:
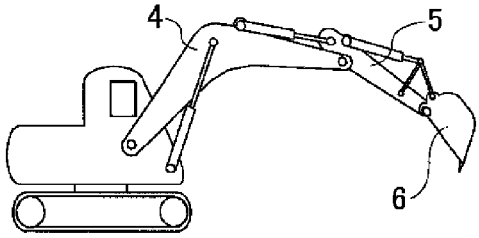

(Dump Operation: FIG. 2F)

When the operator determines that the boom up swiveling operation is completed, then, as shown in FIG. 2F, the arm 5 and the bucket 6 are opened to eject the mud included in the bucket 6. This operation is referred to as a "dump operation", and a period for the dump operation is referred to as a "dump operation period". In the dump operation, it may be that only the bucket 6 is opened to eject the mud.

Figure 2G:
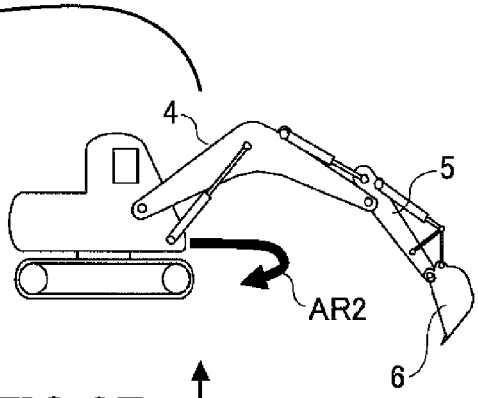

When the operator determines that the dump operation is completed, then, as shown in FIG. 2G, the slewing upper body 3 is swiveled as shown by an arrow AR2 such that the bucket 6 is moved to the predetermined excavating position. At this time, while swiveling the slewing upper body 3, the boom 4 is moved downward such that the front end of the bucket 6 is positioned at the predetermined height from the object to be excavated. This operation is a part of the boom down swiveling operation explained above with reference to FIG. 2A. The operator repeats the operations explained above with reference to FIG. 2A to FIG. 2G.

The "boom down swiveling operation", the "first excavating operation", the "second excavating operation", the "boom up swiveling operation", and the "dump operation" are assumed as one cycle of the operations and the cycle is repeated to perform excavating and loading.

Figure 3:
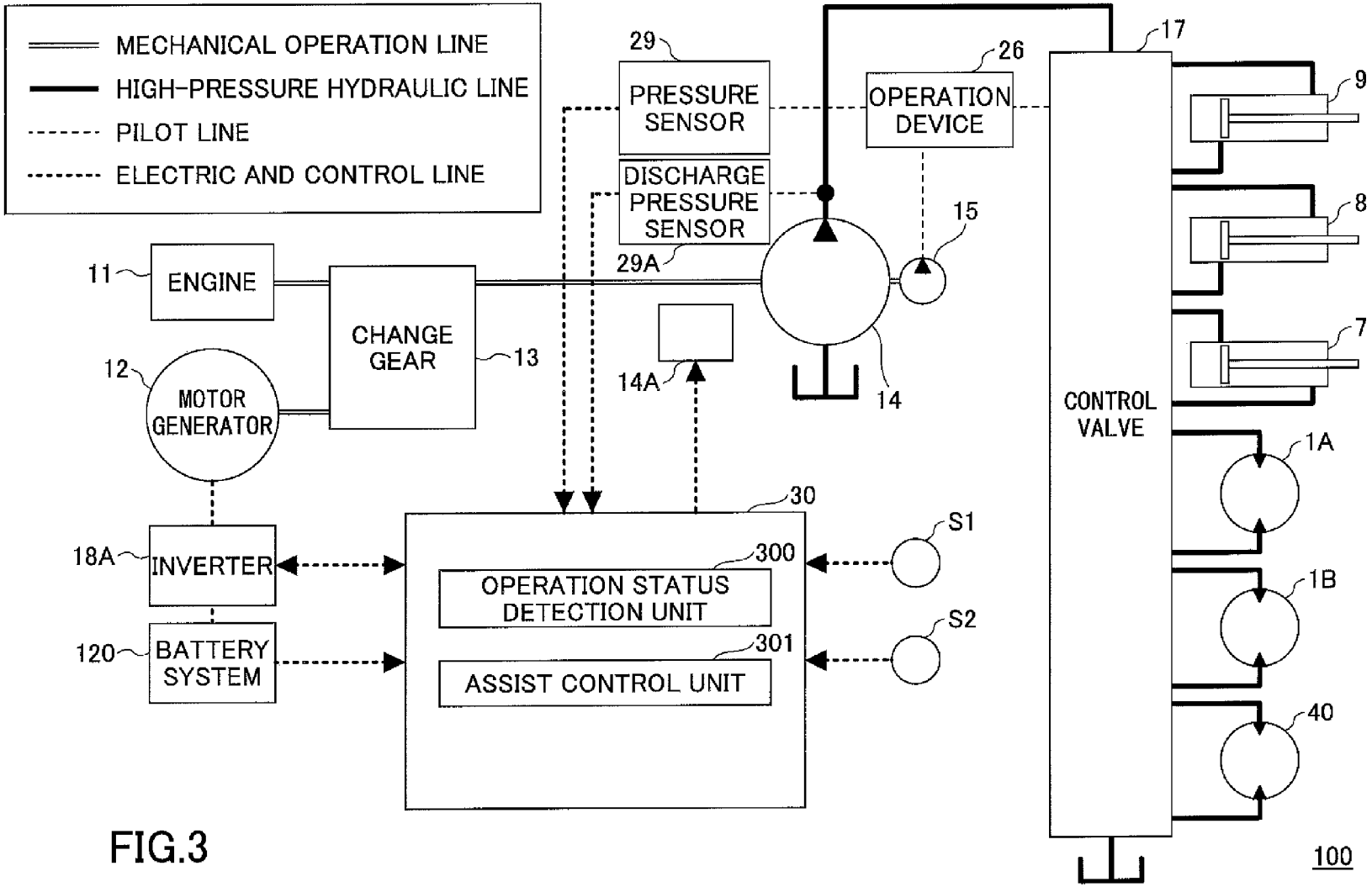
FIG. 3 is a block diagram showing an example of a driving system of the hydraulic shovel.

FIG. 3 is a block diagram showing an example of a driving system of the hydraulic shovel 100 including a mechanical operation line, a high-pressure hydraulic line, a pilot line, and an electric and control line.

The driving system of the hydraulic shovel 100 is mainly composed of an engine 11, a motor generator 12, a change gear 13, a main pump 14, a regulator 14A, a pilot pump 15, a control valve 17, an inverter 18A, an operation device 26, a pressure sensor 29, a discharge pressure sensor 29A, a controller 30, and a battery system 120.

The engine 11 is a driving source of the hydraulic shovel 100. The engine 11 is operated to keep a predetermined engine speed, for example. An output shaft of the engine 11 is connected to input shafts of the main pump 14 and the pilot pump 15 via the change gear 13.

The motor generator 12 selectively performs a power generation operation while being rotated by the engine 11 to generate power, and an assist drive operation while being rotated by the energy stored in the battery system 120 to assist with the required output.

The change gear 13 includes two input shafts and one output shaft where one of the input shafts is connected to the output shaft of the engine 11, the other of the input shafts is connected to a rotation shaft of the motor generator 12, and the output shaft is connected to a rotation shaft of the main pump 14.

The main pump 14 (hydraulic pump) supplies high pressure oil to the control valve 17 via the high-pressure hydraulic line. The main pump 14 may be, for example, a swash plate type variable capacity hydraulic pump.

The regulator 14A controls discharging of the main pump 14. For example, the regulator 14A controls discharging of the main pump 14 by controlling an angle of a swash plate of the main pump 14 based on the discharge pressure of the main pump 14, a control signal from the controller 30 or the like.

The pilot pump 15 supplies the high pressure oil to hydraulic control devices via the pilot line. The pilot pump 15 may be, for example, a fixed capacity hydraulic pump.

The control valve 17 is one of the hydraulic control devices. The control valve 17 controls a hydraulic system of the hydraulic shovel 100. The control valve 17 selectively supplies the high pressure oil supplied by the main pump 14 to one or plural of the boom cylinder 7, the arm cylinder 8, the bucket cylinder 9, a hydraulic motor for traveling 1B (for left), a hydraulic motor for traveling 1A (for right), and a hydraulic motor for swiveling 40, for example. The boom cylinder 7, the arm cylinder 8, the bucket cylinder 9, the hydraulic motor for traveling 1B (for left), the hydraulic motor for traveling 1A (for right), and the hydraulic motor for swiveling 40 are referred to as "hydraulic actuators" hereinafter.

The inverter 18A alternately converts alternating-current power (AC power) and direct-current power (DC power). The inverter 18A converts the AC power generated by the motor generator 12 to DC power to be stored in the battery system 120 (charging operation), and converts the DC power stored in the battery system 120 to AC power to supply the motor generator 12 (discharging operation). The inverter 18A controls terminating, switching, starting or the like of a charging-discharging operation based on the control signal output by the controller 30 and outputs information related to the charging-discharging operation to the controller 30.

The battery system 120 stores DC power. The battery system 120 includes a capacitor, a step-up/step-down converter, and a DC bus (not shown in the drawings). The DC bus controls a power supply between the capacitor and the motor generator 12. The capacitor includes a capacitor voltage detection unit (not shown in the drawings) for detecting a capacitor voltage value, and a capacitor current detection unit (not shown in the drawings) for detecting a capacitor current value. The capacitor voltage detection unit and the capacitor current detection unit respectively, output the capacitor voltage value and the capacitor current value to the controller 30. Further, for the capacitor, a secondary battery such as a lithium ion battery or the like capable of charging and discharging, a double-layer capacitor (such as a lithium ion capacitor) or other kinds of batteries capable of supplying and receiving power may be used.

The operation device 26 includes a lever, a pedal and the like such as an arm control lever (not shown in the drawings) corresponding to the hydraulic actuators for receiving instructions by an operator for operating the hydraulic actuators to supply the pressure oil sent from the pilot pump 15 via the pilot line to pilot ports of the corresponding hydraulic actuators. The pressure (pilot pressure) supplied to the pilot port of each of the hydraulic actuators is determined by an operating direction and an operating amount of the lever, the pedal or the like corresponding to the hydraulic actuator, of the operation device 26.

The pressure sensor 29 (pilot pressure sensor) detects the pilot pressure determined by the operator using the operation device 26. The pressure sensor 29 detects the operating direction and the operating amount of the lever, the pedal or the like of each of the hydraulic actuators as a pressure and outputs the detected pressure to the controller 30, for example. The operation to the operation device 26 may be detected by other kinds of sensors instead of the pressure sensor 29.

The discharge pressure sensor 29A is a load pressure sensor that detects a load applied to the excavating attachment. For example, the discharge pressure sensor 29A detects the discharge pressure of the main pump 14 and outputs the detected value to the controller 30.

The controller 30 controls the hydraulic shovel 100. The controller 30 may be composed of a computer including a Central Processing Unit (CPU), a Random Access Memory (RAM), a Read Only Memory (ROM) or the like, for example. The controller 30 includes an operation status detection unit 300 and an assist control unit 301. The controller 30 reads out programs for the operation status detection unit 300 and the assist control unit 301 from the ROM to have the CPU execute them while using the RAM.

Specifically, the controller 30 receives detected values output by the boom angle sensor S1, the arm angle sensor S2, the inverter 18A, the pressure sensor 29, the discharge pressure sensor 29A, the battery system 120 and the like. The boom angle sensor S1, the arm angle sensor S2, the inverter 18A, the pressure sensor 29, the discharge pressure sensor 29A, the battery system 120 and the like are simply referred to as "sensors" as well.

Then, the controller 30 has the operation status detection unit 300 and the assist control unit 301 execute the respective operations based on the detected values. Subsequently, the controller 30 outputs a control signal obtained by the execution by the operation status detection unit 300 or the assist control unit 301 to the inverter 18A.

The operation status detection unit 300 detects an operation status of the excavating attachment. For example, the operation status detection unit 300 detects a timing from which a predetermined operation by the excavating attachment is about to start (hereinafter simply referred to as an "intention of starting the predetermined operation" based on the detected values output from the sensors.

Specifically, the operation status detection unit 300 detects a time at which the second excavating operation is about to start (hereinafter simply referred to as an "intention of starting the second excavating operation") based on the arm angle "β" output from the arm angle sensor S2 and the discharge pressure "P" output from the discharge pressure sensor 29A.

As described above with reference to FIG. 2B and FIG. 2C, when the first excavating operation is completed and the second excavating operation is starting, the arm 5 and the bucket 6 are further closed. This means that the arm angle "β" becomes smaller at this time. Therefore, in this embodiment, in order to differentiate the first excavating operation and the second excavating operation, a threshold value "$\beta_{TH}$" for the arm angle "β" which can differentiate the first excavating operation and the second excavating operation is previously set and stored in a memory of the controller 30. The threshold value $\beta_{TH}$ may be, for example, equal to an arm angle where the extending direction of the arm 5 becomes substantially orthogonal to the ground.

Further, when the excavating operation is about to start, the discharge pressure "P" of the main pump 14 becomes higher and the assist drive operation by the motor generator 25 is necessary. Therefore, a threshold value "$P_{TH}$" for the discharge pressure "P" which indicates a high-load status is previously set and stored in a memory of the controller 30.

Specifically, the operation status detection unit 300 detects the intention of starting the second excavating operation when the discharge pressure "P" of the main pump 14 becomes more than or equal to the threshold value "$P_{TH}$" after the arm angle "β" becomes smaller than the threshold value "$\beta_{TH}$".

Alternatively, the operation status detection unit 300 may detect the intention of starting the second excavating operation based on a detected value output from an arm cylinder pressure sensor (load pressure sensor, not shown in the drawings) instead of the discharge pressure "P" output from the discharge pressure sensor 29A. In this case, the operation status detection unit 300 detects the intention of starting the second excavating operation when the pressure in the bottom side of the arm cylinder 8 becomes greater than or equal to a predetermined pressure, after the arm angle β becomes less than the threshold value "$\beta_T$".

Further alternatively, the operation status detection unit 300 may detect the intention of starting the second excavating operation based only on the arm angle "β" detected by the arm angle sensor S2, or based the arm angle "β" detected by the arm angle sensor S2 and the boom angle "α" detected by the boom angle sensor S1.

Further alternatively, the operation status detection unit 300 may detect the intention of starting the second excavating operation based on a detected value output from the pressure sensor 29.

Specifically, the operation status detection unit 300 may detect the intention of starting the second excavating operation when it is detected that an operating amount of the arm control lever of the operation device 26 becomes more than a predetermined amount, after the arm angle "β" which was previously more than or equal to the threshold value "$\beta_{TH}$" becomes smaller than the threshold value "$\beta_{TH}$". In this case, the operation status detection unit 300 may detect the intention of starting the second excavating operation when the pressure detected by the pressure sensor 29 is greater than or equal to a predetermined value.

With this operation, an error in detecting the intention of starting the second excavating operation when the arm control lever is slightly moved, can be prevented.

Similarly, the operation status detection unit 300 detects an intention of starting and completing predetermined operations by the excavating attachment based on the detected values output from the sensors.

Specifically, the operation status detection unit 300 detects a completion of the second excavating operation when it is detected that the operating amount of the arm control lever becomes less than a predetermined amount after the intention of starting the second excavating operation is detected.

These conditions for detecting the intention of starting or the completion of the predetermined operation are just examples and the operation status detection unit 300 may use other conditions for detecting the intention of starting or the completion of the predetermined operation.

In all cases, corresponding threshold values are previously set and stored in the memory of the controller 30.

Further, the operation status detection unit 300 may detect the intention of starting or the completion of the operations at other periods, in addition to the second excavating operation period, such as the boom down swiveling operation period, the first excavating operation period, the boom up swiveling operation period, and the dump operation period.

Further, the operation status detection unit 300 outputs the control signal to the assist control unit 301 indicating the intention of starting or the completion of the predetermined operation when the intention of starting or the completion of the corresponding operation is detected.

The assist control unit 301 controls the assist drive operation by the motor generator 12. Upon receiving the control signal from the operation status detection unit 300, the assist control unit 301 determines whether the assist drive operation by the motor generator 12 is to be started based on the control signal, for example.

Specifically, the assist control unit 301 determines to start the assist drive operation by the motor generator 12 when the operation status detection unit 300 detects the intention of starting the second excavating operation.

With this operation, the assist control unit 301 can have the motor generator 12 start the assist drive operation before the second excavating operation is actually started.

Further, after the assist control unit 301 determines to start the assist drive operation, the assist control unit 301 determines to terminate the assist drive operation by the motor generator 12 when the operation status detection unit 300 detects the completion of the second excavating operation.

The assist control unit 301 may determine to terminate the assist drive operation by the motor generator 12 when the intention of starting or the completion of other operations by the excavating attachment is detected, such as the boom up swiveling operation, the dump operation, the boom down swiveling operation and the like, after the assist drive operation is started.

Figure 4:
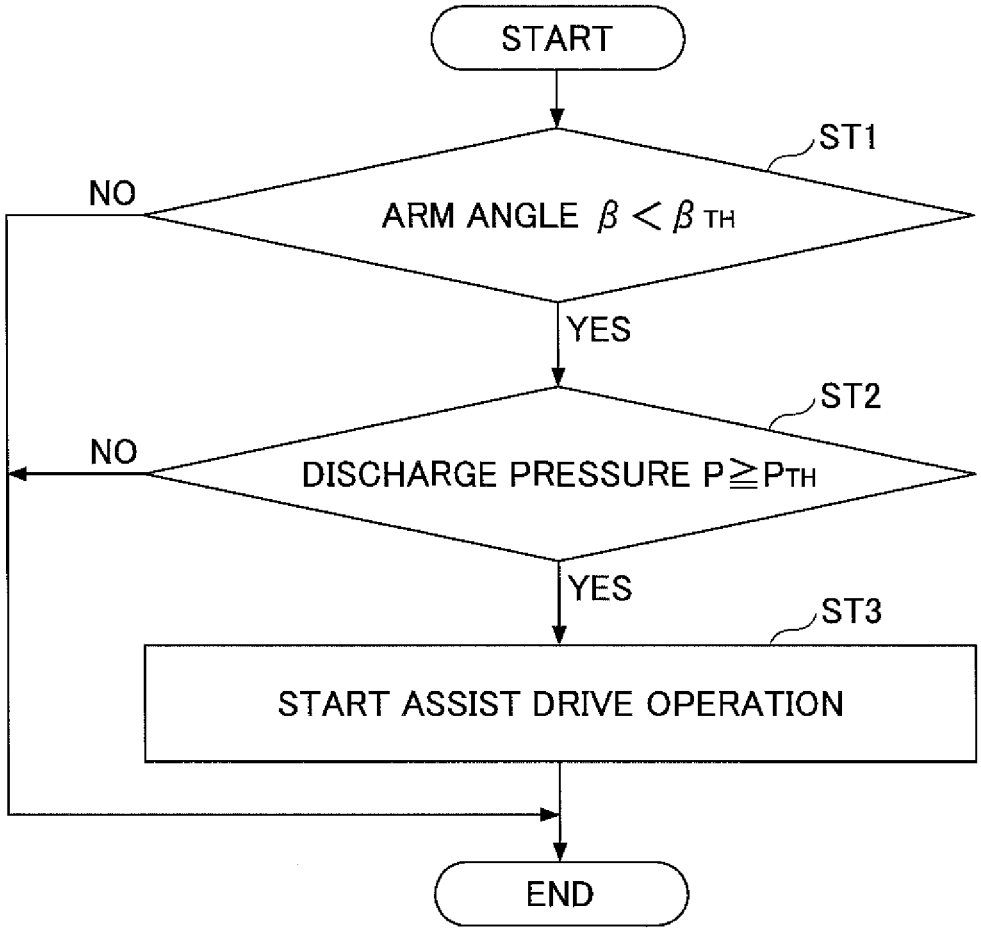
FIG. 4 is a flowchart showing an operation of a controller of the hydraulic shovel.

FIG. 4 is a flowchart showing an operation of the controller 30 in which the controller 30 determines whether to start the assist drive operation by the motor generator 12. This determining operation is referred to as an "assist start determining operation" hereinafter. The assist start determining operation is repeated at a predetermined interval until the second excavating operation of the excavating attachment is started (for example, until when the arm angle "β" becomes less than the threshold value "$\beta_{TH}$").

First, the operation status detection unit 300 of the controller 30 compares a detected value of an arm angle "β" by the arm angle sensor S2 and the threshold value "$\beta_{TH}$" (step ST1).

When it is determined that the detected arm angle "β" is greater than or equal to the threshold value "$\beta_{TH}$" (NO in step ST1), the operation status detection unit 300 determines that it is the first excavating operation period and ends the assist start determining operation.

When, on the other hand, it is determined that the detected arm angle "β" is less than the threshold value "$\beta_{TH}$" (YES in step ST1), the operation status detection unit 300 compares a detected value of a discharge pressure "P" by the discharge pressure sensor 29A and the threshold value "$P_{TH}$" (step ST2).

When it is determined that the discharge pressure "P" is less than the threshold value "$P_{TH}$" (NO in step ST2), the operation status detection unit 300 determines that the load is small and the assist drive operation by the motor generator 25 is unnecessary and ends the assist start determining operation.

When, on the other hand, it is determined that the detected value (discharge pressure) "P" is greater than or equal to the threshold value "$P_{TH}$" (YES in step ST2), the operation status detection unit 300 starts the assist drive operation by the motor generator 12 (step ST3). Further, the assist control unit 301 of the controller 30 controls the regulator 14A to increase the power (horsepower) of the main pump 14. At this time, the operation status detection unit 300 may determine whether to start the assist drive operation based on the pressure in the bottom side of the arm cylinder 8 instead of the discharge pressure "P" of the main pump 14, and determine to start the assist drive operation when the pressure in the bottom side of the arm cylinder 8 is greater than or equal to a predetermined threshold value.

When the assist drive operation by the motor generator 12 is started, torque applied to the input shaft of the main pump 14 becomes greater.

Figure 5A:
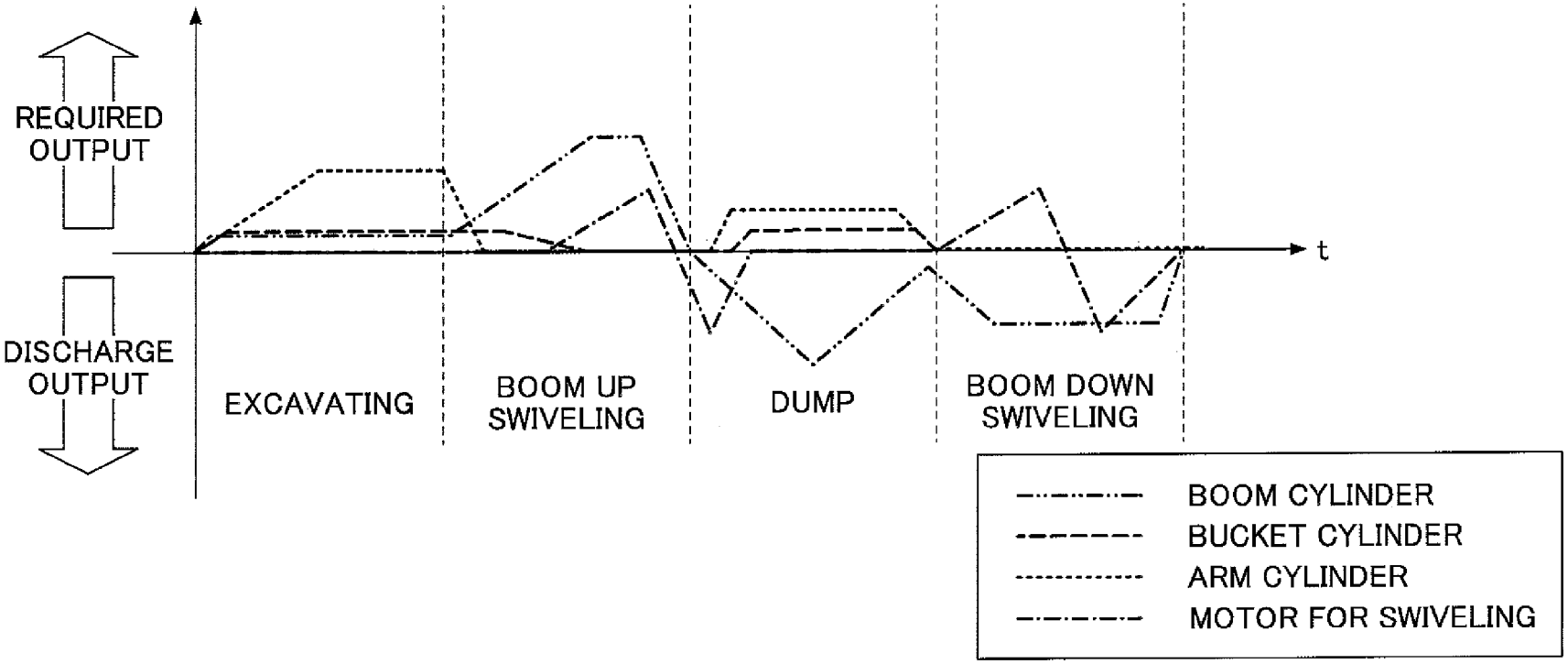
FIG. 5A to FIG. 5C are views for explaining the mechanism of increasing pump power of an assist drive operation by a motor generator in a second excavating operation period.
Figure 5B:
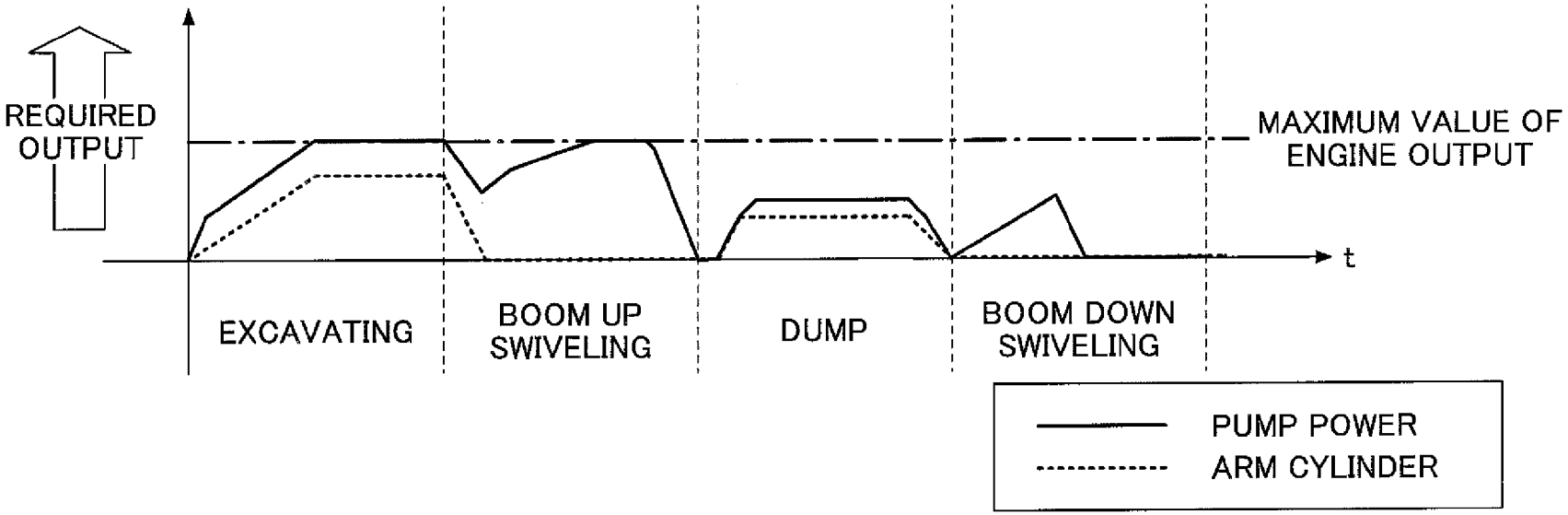
Figure 5C:
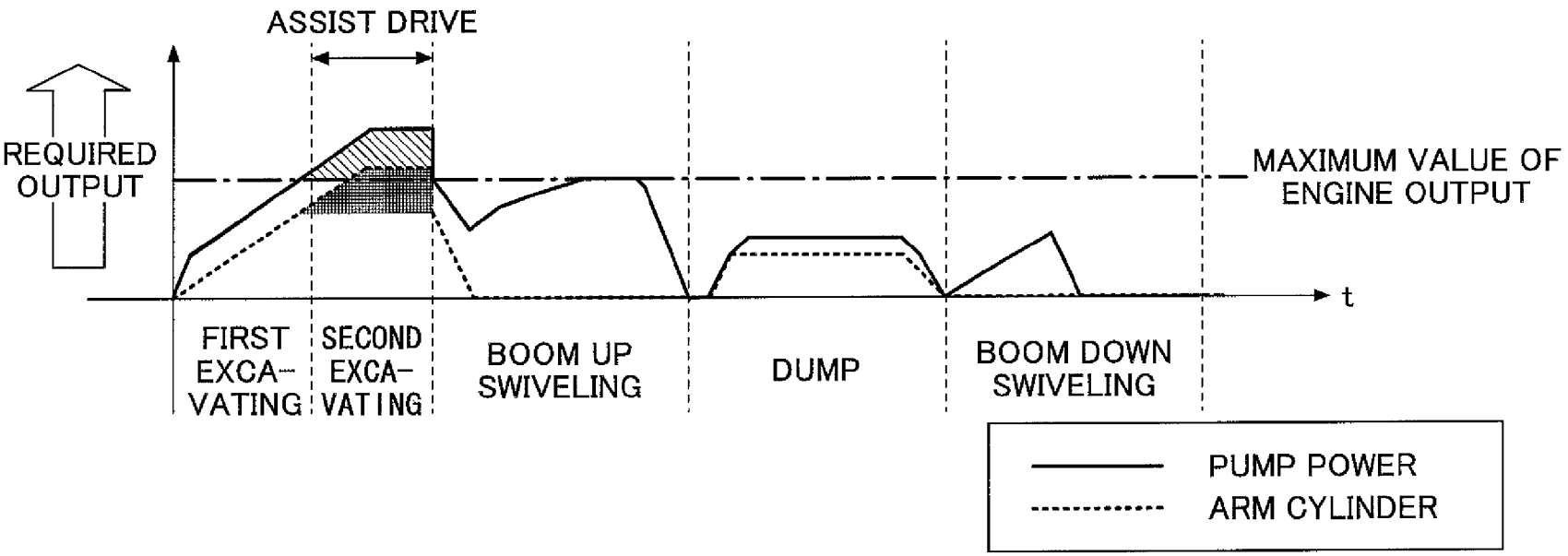

FIG. 5A to FIG. 5C are views for explaining the mechanism of increasing the pump power of the main pump 14 by the assist drive operation by the motor generator 12 in the second excavating operation period.

FIG. 5A to FIG. 5C show required outputs and discharge outputs of the hydraulic actuators. The "required output" means an output necessary to be consumed from the engine output for operating the corresponding hydraulic actuator, and the "discharge output" means an output generated and discharged by the corresponding hydraulic actuator.

FIG. 5A shows required outputs of the boom cylinder 7, the arm cylinder 8, the bucket cylinder 9, and the hydraulic motor for swiveling 40, and discharge outputs from the boom cylinder 7 and the hydraulic motor for swiveling 40. In, FIG. 5A, the assist drive operation by the motor generator 12 is not performed.

FIG. 5B shows a required output of the main pump 14 (pump power), which is the total output of the hydraulic actuators shown in FIG. 5A, and a required output of the arm cylinder 8. In FIG. 55 as well, the assist drive operation by the motor generator 12 is not performed.

FIG. 5C shows the required output of the main pump 14 (pump power) and the required output from the arm cylinder 8 where the assist drive operation by the motor generator 12 for the second excavating operation period is performed to increase the pump power.

First, reference to FIG. 5A and FIG. 5B, the case is explained where the assist drive operation by the motor generator 12 for the second excavating operation period is not performed. As shown in FIG. 5A and FIG. 5B, when the excavating operation by the excavating attachment is performed, the pump power becomes the total of the outputs from the boom cylinder 7, the arm cylinder 8, and the bucket cylinder 9.

When the excavating and loading operation is started, the pump power for the first excavating operation period is increased in accordance with the excavating operation, where the required output of the arm cylinder 8 is the main component.

Then, during the second excavating operation period, the pump power becomes the maximum value of the engine output. This means that the required output in the second excavating operation period exceeds the maximum value of the engine output. However, in this case, the pump power cannot be increased more than the maximum value of the engine output. Therefore, even if a greater load is applied to the arm cylinder 8 at this time, the sufficient power is not supplied to the arm cylinder 8. Thus, in the second excavating operation period, the power sufficient for the required output of the arm cylinder 8 cannot be supplied such that the movement of the arm 5 is slowed. This causes the operator to feel a rough operation.

When the boom up swiveling operation by the excavating attachment is performed, the pump power becomes the total of the required outputs of the boom cylinder 7, the arm cylinder 8, the bucket cylinder 9, and the hydraulic motor for swiveling 40.

The required outputs of the arm cylinder 8 and the bucket cylinder 9 are decreased to disappear as the boom up swiveling operation proceeds.

The required outputs of the boom cylinder 7 and the hydraulic motor for swiveling 40 are increased as the boom up swiveling operation proceeds, and decreased to disappear toward the completion of the boom up swiveling operation.

As a result, during the boom up swiveling operation, the pump power is first decreased from the maximum value of the engine output, increased again to be the maximum value of the engine output, and then decreased to disappear toward the completion of the boom up swiveling operation.

When the dump operation by the excavating attachment is performed, the pump power becomes the total of the required outputs of the arm cylinder 8 and the bucket cylinder 9. When the dump operation by the excavating attachment is performed, the boom cylinder 7 and the hydraulic motor for swiveling 40 generate discharge outputs instead of consuming the engine output. This is because the boom 4 moves downward due to the dead load and the stewing upper body 3 is slowed to be terminated.

The required outputs of the arm cylinder 8 and the bucket cylinder 9 are increased when the dump operation is started, kept at respective constant values for a while, and then decreased to disappear toward the completion of the dump operation.

As a result, during the dump operation, the pump power does not reach the maximum value of the engine output and decreases to disappear toward the completion of the dump operation.

When the boom down swiveling operation by the excavating attachment is performed, the pump power becomes equal to the required output of the hydraulic motor for swiveling 40.

Therefore, during the boom down swiveling operation, the pump power, in other words, the required output of the hydraulic motor for swiveling 40 is increased in accordance with increasing of the swiveling acceleration of the slewing upper body 3 and is decreased to disappear in accordance with decreasing and disappearance of the swiveling acceleration of the slewing upper body 3.

The hydraulic motor for swiveling 40 generates the discharge output after the required output of the hydraulic motor for swiveling 40 has disappeared. The discharge output generated by the hydraulic motor for swiveling 40 is increased in accordance with increasing of the swiveling deceleration of the slewing upper body 3 and is decreased to disappear in accordance with decreasing and disappearance of the swiveling deceleration of the slewing upper body 3.

When the boom down swiveling operation by the excavating attachment is performed, the boom cylinder 7 generates the discharge output instead of consuming the engine output. This is because the boom 4 moves downward due to the dead load.

The mechanism of the assist drive operation by the motor generator 12 in the second excavating operation to increase the pump power is explained with reference to FIG. 5B and FIG. 5C.

The lines shown in FIG. 5B and FIG. 5C express the pump power. The pump power shown in FIG. 5C includes the output from the motor generator 12 when the assist drive operation of the motor generator 12 is performed. The portion with inclined hatching lines shown in FIG. 5C expresses the increase of the pump power by the assist drive operation of the motor generator 12. Further, the portion with crossing hatching lines shown in FIG. 5C expresses the increase of the required output of the arm cylinder 8 with respect to the required output to the arm cylinder 8 when the assist drive operation is not performed in the excavating operation.

As described above, the pump power can be increased by the assist drive operation of the motor generator 12 in the second excavating operation.

As a result, the controller 30 can increase the output of the arm cylinder 8 in the second excavating operation so that slowing of the movement of the arm 5 can be prevented. Similarly, the controller 30 can increase the output of the bucket cylinder 9 in the second excavating operation so that slowing of the movement of the bucket 6 can also be prevented.

Specifically, when the assist drive operation of the motor generator 12 is not performed, if the pump power reaches the maximum value of the engine output in the excavating operation, the discharge amount of the main pump 14 decreases as the discharge pressure of the main pump 14 increases. This means that, while the excavating operation proceeds, the amount of the high pressure oil introduced into the arm cylinder 8 decreases as the pressure in the arm cylinder 8 increases. When the amount of the high pressure oil introduced into the arm cylinder 8 decreases, the operation speed (closing speed) of the arm 5 becomes slow.

On the other hand, when the assist drive operation of the motor generator 12 is performed, the pump power is increased such that the discharge amount of the main pump 14 is maintained at a constant level greater than the maximum value of the engine output even if the discharge pressure of the main pump 14 is increased. It means that even when the pressure in the arm cylinder 8 is increased as the excavating operation proceeds, the amount of the high pressure oil introduced into the arm cylinder 8 does not change. When the amount of the high pressure oil introduced into the arm cylinder 8 is constant, the operation speed (closing speed) of the arm 5 is also kept at a constant level. The operation speed (closing speed) of the bucket 6 is also the same.

Figure 6A:
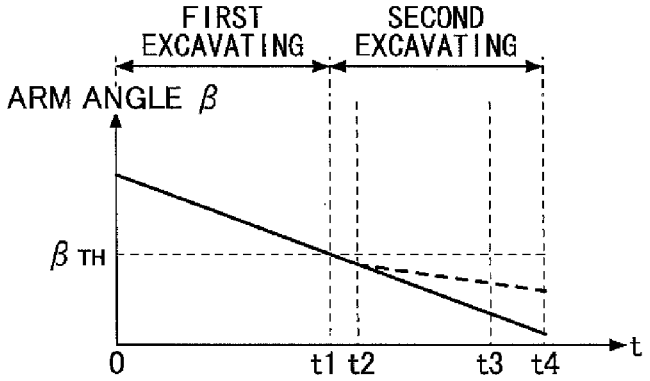
FIG. 6A to FIG. 6E are views showing conditions of the components of the hydraulic shovel when the controller starts the assist drive operation of the motor generator.
Figure 6B:
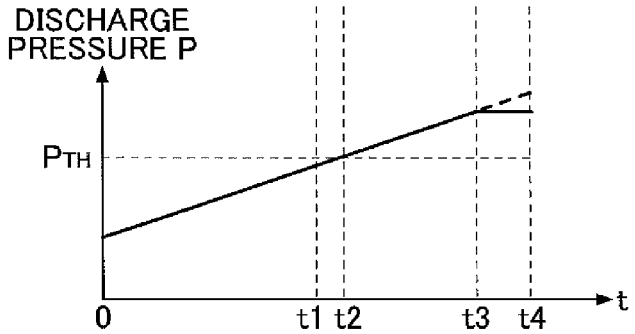
Figure 6C:
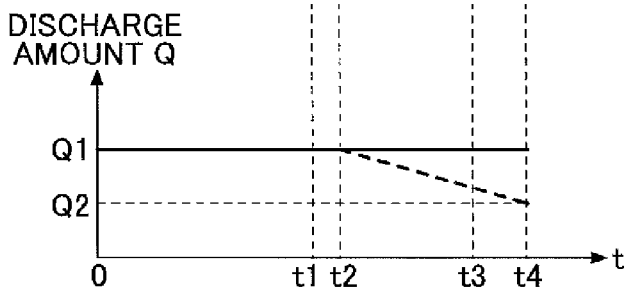
Figure 6D:
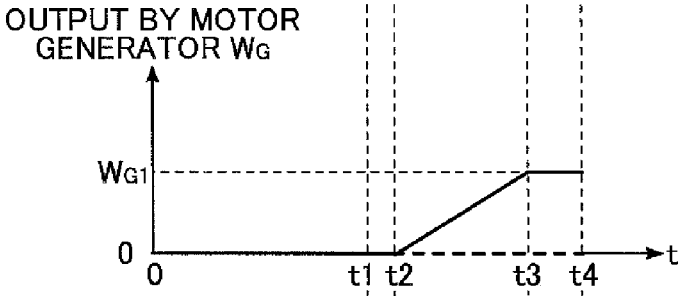
Figure 6E:
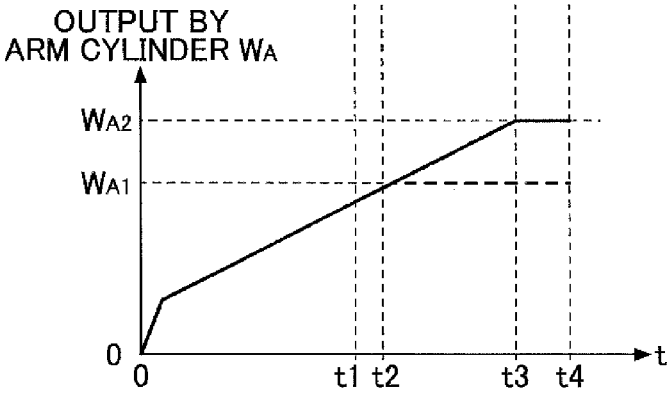

FIG. 6A to FIG. 6E are views showing conditions of the components of the hydraulic shovel 100 when the controller 30 starts the assist drive operation of the motor generator 12. FIG. 6A shows an arm angle "β" of the arm 5, FIG. 6B shows a discharge pressure "P" of the main pump 14, FIG. 6C shows the discharge amount "Q" of the main pump 14, FIG. 6D shows the output value "$W_G$" of the motor generator 12, and FIG. 6E shows the output value "$W_A$" of the arm cylinder 8.

For the conditions shown in FIG. 6A to FIG. 6E, it is assumed that the operator of the hydraulic shovel 100 starts the operation of the hydraulic shovel 100 where the arm 5 is opened greater than the threshold value $\beta_{TH}$. Further, the lines shown in FIG. 6A to FIG. 6E express the values when the assist drive operation of the motor generator 12 for increasing the pump power is performed, while the dotted lines shown in FIG. 6A to FIG. 6E express the values when the assist drive operation of the motor generator 12 for increasing the pump power is not performed.

As shown by the line in FIG. 6A, the arm angle "β" is decreased at a constant decrement rate from an angle greater than the threshold value "$\beta_{TH}$". The arm angle "β" becomes the threshold value "$\beta_{TH}$" at the time "t1" and then is further decreased at the constant decrement rate until the completion of the second excavating operation (time "t4").

As shown by the line in FIG. 6B, the discharge pressure "P" is increased at a constant increment rate from a value less than the threshold value "$P_{TH}$". The discharge pressure "P" becomes the threshold value $P_{TH}$ at the time "t2", is further increased at the constant increment rate until the pump power reaches the maximum value of the load at the time "t3", and then is kept at a constant level until the completion of the second excavating operation (time "t4").

As shown by the line in FIG. 6C, the discharge amount "Q" is kept at a constant predetermined value "Q1" from the start of the excavating operation to the completion of the second excavating operation.

As shown by the line in FIG. 6D, the output value "$W_G$" of the motor generator 12 is started to increase from zero at the time "t2" to a value "$W_{G1}$" at the time "t3", and then is kept at the value "$W_{G1}$" until the completion of the second excavating operation.

In FIG. 6E, the maximum value of the engine output when the assist drive operation by the motor generator 12 is not performed is assumed as "$W_{A1}$" (which will be referred to as an "original maximum value "$W_{A1}$""). The maximum value of the engine output when the assist drive operation by the motor generator 12 is performed, which is raised by the assist drive operation by the motor generator 12, is assumed as "$W_{A2}$" (which will be referred to as an "increased maximum value "$W_{A2}$"").

As shown by the line in FIG. 6E, the output value "$W_A$" of the arm cylinder 8 is started at a value less than the upper limit value, which is determined by the original maximum value "$W_{A1}$", increased at a constant increment rate to reach the original maximum value "$W_{A1}$" as it is about passing the time "t2". Then, the output value "$W_A$" of the arm cylinder 8 is increased at the constant increment rate until the pump power reaches the maximum value of the load at the time "t3" to become the increased maximum value "$W_{A2}$", and is kept at the maximum value "$W_{A2}$" until the completion of the excavating operation. By the assist drive operation of the motor generator 12, the maximum value of the engine output is increased to "$W_{A2}$" from "$W_{A1}$". The increased maximum value "$W_{A2}$" is determined by the pump power (including the output from the motor generator 12) when the assist drive operation of the motor generator 12 is performed, and the output value "$W_A$" of the arm cylinder 8 is kept lower than or equal to the increased maximum value "$W_{A2}$" even when the assist drive operation of the motor generator 12 is performed. As explained above, in the second excavating operation, the increased maximum value "$W_{A2}$", which is the upper limit value of the output value "$W_A$" of the arm cylinder 8, becomes equal to the total of the original maximum value "$W_{A1}$" and the output value "$W_{G1}$" of the motor generator 12 when almost all of the output value "$W_G$" of the motor generator 12 is used as the output value "$W_A$" of the arm cylinder 8.

The relationship between the arm angle "β", the discharge pressure P of the main pump 14, the discharge amount "Q" of the main pump 14, the output value "$W_G$" of the motor generator 12, and the output value "$W_A$" of the arm cylinder 8 when the controller 30 starts the assist drive operation of the motor generator 12, is explained.

The operator operates the arm control lever in a direction to close the arm 5 during the time "0" to the time "t1" so that the arm angle "β" is decreased as the time goes by to be lower than the threshold value "$\beta_{TH}$" at the time "t1". On the other hand, the discharge pressure "P" of the main pump 14 and the output value "$W_A$" of the arm cylinder 8 are increased as the time goes by because the reaction force of excavating increases. At this time, as the pump power does not reach original maximum value "$W_{A1}$" yet, the discharge amount "Q" of the main pump 14 is maintained at the predetermined amount "Q1", and the output value "$W_G$" of the motor generator 12 is kept at zero.

At the time "t2", when the discharge pressure "P" becomes more than or equal to the threshold value "$P_{TH}$", the regulator 14A is adjusted by the control signal from the assist control unit 301 to increase the power of the main pump 14, and the assist drive operation of the motor generator 12 is started such that the output value "$W_G$" of the motor generator 12 is started to increase. As the output value "$W_G$" of the motor generator 12 increases, the pump power exceeds the original maximum value "$W_{A1}$" to be the increased maximum value "$W_{A2}$". At this time, the output value "$W_A$" of the arm cylinder 8 exceeds the original maximum value "$W_{A1}$" to be the increased maximum value "$W_{A2}$". Thus, even when the discharge pressure "P" is increased, the discharge amount "Q" is kept at the predetermined amount "Q1", and the amount of the high pressure oil introduced into the arm cylinder 8 can be kept at a predetermined value even when the pressure in the arm cylinder 8 increases. As a result, the change rate of the arm angle "β" between the time "0" and the time "t2" can be maintained after the time "t2". It means that the operation speed of the arm 5 can be maintained.

When the output value "$W_G$" of the motor generator 12 reaches the value "$W_{G1}$" at the time "t3", the pump power reaches the increased maximum value "$W_{A2}$" so that the output value "$W_A$" of the arm cylinder 8 is limited by the increased maximum value "$W_{A2}$".

On the other hand, when the assist drive operation of the motor generator 12 is not performed, the output value "$W_G$" of the motor generator 12 is kept at zero even when the discharge pressure "P" becomes more than or equal to the threshold value "$P_{TH}$" at the time "t2" and the pump power is also kept at the original maximum value "$W_{A1}$". Thus, the output value "$W_A$" of the arm cylinder 8 reaches the original maximum value "$W_{A1}$." at the time "t2" and is kept at the original maximum value "$W_{A1}$". Therefore, for the case when the assist drive operation of the motor generator 12 is not performed, when the discharge pressure "P" becomes more than or equal to the threshold value "$P_{TH}$" at the time "t2", the discharge amount "Q" of the main pump 14 is started to decrease. As a result, the change rate of the arm angle "β" becomes smaller after the time "t2" compared with the change rate between the time "0" and the time "t2". It means that the operation speed of the arm 5 becomes slower.

With the above structure, the movement of the excavating attachment can be smooth in the second excavating operation due to the assist drive operation of the motor generator 12 in the hydraulic shovel 100 according to the first embodiment.

Further, according to the hydraulic shovel 100 of the first embodiment, by preventing slowing down of the operation speed of the excavating attachment in the second excavating operation, the rough operation can be prevented from being felt by the operator. As a result, it is not necessary for the operator to move the boom 4 upward in order to reduce the reaction force of excavating for preventing slowing down of the operation speed of the excavating attachment in the second excavating operation. Thus, the hydraulic shovel 100 of the first embodiment can prevent decrease of the operating efficiency.

Further, as the hydraulic shovel 100 of the first embodiment starts the assist drive operation of the motor generator 12 after the intention of starting the second excavating operation is detected, an unnecessary assist drive operation is prevented from being performed.

Further, in the first embodiment, although in the example the operation status detection unit 300 determines the intention of starting the second excavating operation based on the detected value of the arm angle sensor S2, this detection may be performed based on the detected value of the arm angle sensor S2 and the detected value of the pressure sensor 29.

Further, in the first embodiment, although the assist drive operation for closing the arm 5 in the excavating is described, an assist drive operation for closing the bucket 6 in the excavating may be performed by increasing the power of the main pump 14 as well.

Further, in the first embodiment, although the example where the assist drive operation of the motor generator 12 is started by the assist control unit 301, if the assist drive operation is already being performed in the first excavating operation period, the assist control unit 301 may increase the output by the assist drive operation of the motor generator 12 in the second excavating operation. With this, the power of the main pump 14 can be increased, thereby not slowing the movement of the excavating attachment in the second excavating operation.

Second Embodiment

An example of a driving system of the hydraulic shovel 100 of the second embodiment is explained with reference to FIG. 7.

Figure 7:
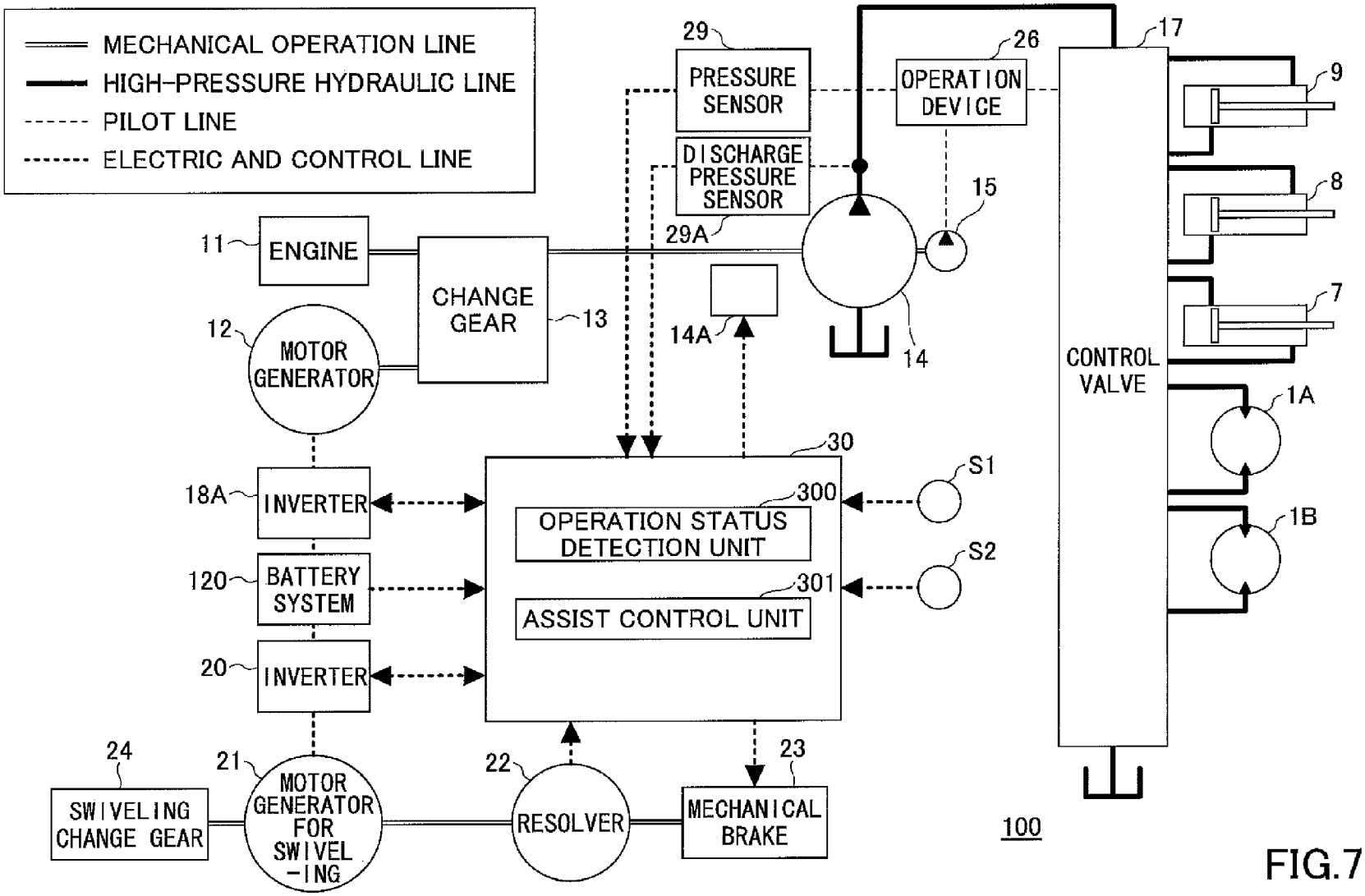
FIG. 7 is a block diagram showing another example of a driving system of the hydraulic shovel.

FIG. 7 is a block diagram showing the example of the driving system of the hydraulic shovel 100 including a mechanical operation line, a high-pressure hydraulic line, a pilot line, and an electric and control line.

The driving system shown in FIG. 7 differs from that shown in FIG. 3 only at a point where a motor mechanism for swiveling is included instead of the hydraulic motor for swiveling 40. The same explanation as the first embodiment is not repeated.

The motor mechanism for swiveling is mainly composed of an inverter 20, a motor generator for swiveling 21, a resolver 22, a mechanical brake 23, and a swiveling change gear 24.

The inverter 20 alternately converts AC power and DC power. The inverter 20 converts the AC power generated by the motor generator for swiveling 21 to DC power to be stored in the battery system 120 (charging operation), and converts the DC power stored in the battery system 120 to AC power to supply the motor generator for swiveling 21 (discharging operation). Further, the inverter 20 controls terminating, switching and starting of a charging-discharging operation based on the control signal output by the controller 30, and outputs information related to the charging-discharging operation to the controller 30.

The motor generator for swiveling 21 is rotated by power stored in the battery system 120 and selectively performs power running in which the slewing mechanism 2 is swiveled and a regenerative operation in which kinetic energy of the swiveled slewing mechanism 2 is converted to electrical energy.

The resolver 22 detects the speed of the slewing mechanism 2 and outputs the detected value to the controller 30.

The mechanical brake 23 controls the slewing mechanism 2. The mechanical brake 23 mechanically disables the slewing mechanism 2 not to swivel based on the control signal output from the controller 30.

The swiveling change gear 24 includes an input shaft and an output shaft where the input shaft is connected to the rotation shaft of the motor generator for swiveling 21 and the output shaft is connected to the rotation shaft of the slewing mechanism 2.

The controller 30 receives detected values output by the boom angle sensor S1, the arm angle sensor S2, the inverter 18A, the inverter 20, resolver 22, the pressure sensor 29, the discharge pressure sensor 29A, the battery system 120 and the like. Then, the controller 30 has the operation status detection unit 300 and the assist control unit 301 execute the respective operations based on the detected values. Subsequently, the controller 30 outputs a control signal obtained by the execution by the operation status detection unit 300 or the assist control unit 301 to the inverter 18A and the inverter 20.

With the above structure, according to the hydraulic shovel 100 of the second embodiment, the same merits as the hydraulic shovel 100 of the first embodiment can be obtained.

According to the embodiment, a hydraulic shovel capable of smoothing a movement of an excavating attachment in an excavating operation is provided.

The present invention is not limited to the specifically disclosed embodiments, and variations and modifications may be made without departing from the scope of the present invention.

The present application is based on Japanese Priority Application No. 2011-80728 filed on Mar. 31, 2011, the entire contents of which are hereby incorporated herein by reference.

What is claimed is:

1. A hydraulic shovel comprising:

a traveling lower body;

a slewing upper body that is mounted on the traveling lower body as being capable of being slewed;

an engine;

a hydraulic pump driven by the engine;

an excavating attachment including a boom provided at the slewing upper body, an arm rotatably provided at a front end of the boom and a bucket rotatably provided at a front end of the arm;

a boom cylinder that drives the boom by being provided with high pressure oil of the hydraulic pump;

an arm cylinder that drives the arm by being provided with high pressure oil of the hydraulic pump;

a bucket cylinder that drives the bucket by being provided with high pressure oil of the hydraulic pump;

a motor generator connected to the hydraulic pump; and a controller, wherein, upon detecting a closing operation in which the arm is moved close to the slewing upper body, the controller controls to increase torque applied to an input shaft of the hydraulic pump by the motor generator to increase a horsepower of the hydraulic pump.

2. The hydraulic shovel according to claim 1, wherein, upon detecting the closing operation in which the arm is moved close to the slewing upper body, the controller controls to increase the horsepower of the hydraulic pump by increasing an initial maximum value of the horsepower of the hydraulic pump defined by a maximum value of an engine output to become an assist-time maximum value that is greater than the initial maximum value.

3. The hydraulic shovel according to claim 1, further comprising:

a load pressure sensor that detects a load applied to the excavating attachment, wherein when an angle of the arm in the closing operation becomes less than a first predetermined threshold value and when the load detected by the load pressure sensor is greater than or equal to a second predetermined threshold value, the controller controls to increase the torque applied to the input shaft of the hydraulic pump by the motor generator to increase the horsepower of the hydraulic pump.

4. The hydraulic shovel according to claim 1, wherein when the angle of the arm in the closing operation becomes less than the first predetermined threshold value, when an operating amount of an arm control lever of the arm becomes greater than a third predetermined threshold value and when the load detected by the load pressure sensor is greater than or equal to the second predetermined threshold value, the controller controls to increase the torque applied to the input shaft of the hydraulic pump by the motor generator to increase the horsepower of the hydraulic pump.

5. The hydraulic shovel according to claim 4, wherein the load pressure sensor is a discharge pressure sensor that is provided between the hydraulic pump and a control valve connected to each cylinder of the boom, the arm and the bucket of the excavating attachment, and that detects discharge pressure of the hydraulic pump.

6. The hydraulic shovel according to claim 1, wherein when the closing operation is continued and the angle of the arm in the closing operation becomes less than a first predetermined threshold value, the controller determines that a latter part of an excavating operation of the excavating attachment has started, and controls to increase the torque applied to the input shaft of the hydraulic pump by the motor generator to increase the horsepower of the hydraulic pump.

7. The hydraulic shovel according to claim 1, further comprising:

an arm cylinder pressure sensor that detects a pressure applied to the arm cylinder, wherein when the angle of the arm in the closing operation becomes less than a first predetermined threshold value and when the pressure detected by the arm cylinder pressure sensor is greater than or equal to a fourth predetermined threshold value, the controller determines that a latter part of an excavating operation of the excavating attachment has started, and controls to increase the torque applied to the input shaft of the hydraulic pump by the motor generator to increase the horsepower of the hydraulic pump.

8. The hydraulic shovel according to claim 7, wherein when an operating amount of an arm control lever of the arm becomes greater than a third predetermined threshold value, in addition to that the angle of the arm in the closing operation becomes less than the first predetermined threshold value and the pressure detected by the arm cylinder pressure sensor is greater than or equal to the fourth predetermined threshold value, the controller determines that the latter part of an excavating operation of the excavating attachment has started, and controls to increase the torque applied to the input shaft of the hydraulic pump by the motor generator to increase the horsepower of the hydraulic pump.

9. The hydraulic shovel according to claim 6, wherein the latter part of the excavating operation includes a period subsequent to a time at which the angle of the arm in the closing operation with respect to the ground becomes substantially orthogonal.

10. The hydraulic shovel according to claim 8, wherein the controller determines that the latter part of the excavating operation of the excavating attachment is completed when an operating amount of the an arm control lever of the arm becomes less than or equal to the third predetermined threshold value and controls to decrease the horsepower of the hydraulic pump by decreasing the maximum value of the horsepower of the hydraulic pump.

11. The hydraulic shovel according to claim 6, wherein the latter part of the excavating operation includes a period subsequent to a time at which the arm and the bucket perform closing operations after the closing operation of the arm is continued and the angle of the arm in the closing operation becomes less than the first predetermined threshold value, and wherein the closing operations of the arm and the bucket are assisted by increasing of the horsepower of the hydraulic pump.

12. The hydraulic shovel according to claim 1, wherein the hydraulic pump is a variable capacity hydraulic pump capable of adjusting a maximum horsepower by changing a discharging amount of the high pressure oil by a regulator, and wherein the controller controls to increase the horsepower of the hydraulic pump by controlling the regulator to increase the discarding amount of the high pressure oil of the hydraulic pump in the closing operation of the arm.

13. The hydraulic shovel according to claim 8, wherein, after the latter part of the excavating operation of the excavating attachment has started, the controller determines that the latter part of the excavating operation of the excavating attachment is completed when the operating amount of the arm control lever becomes less than a third predetermined threshold value, and terminates increasing of the torque applied to the input shaft of the hydraulic pump by the motor generator.

14. The hydraulic shovel according to claim 1, wherein the controller includes an operation status detection unit that detects a start and an end of at least one of an excavating operation, a boom up swiveling operation, a dump operation and a boom down swiveling operation.

15. A hydraulic shovel comprising:

a traveling lower body;

a slewing upper body that is mounted on the traveling lower body as being capable of being slewed;

an engine;

a hydraulic pump driven by the engine;

an excavating attachment including a boom provided at the slewing upper body, an arm rotatably provided at a front end of the boom, and a bucket rotatably provided at a front end of the arm;

a boom cylinder that drives the boom by being provided with high pressure oil of the hydraulic pump;

an arm cylinder that drives the arm by being provided with high pressure oil of the hydraulic pump;

a bucket cylinder that drives the bucket by being provided with high pressure oil of the hydraulic pump;

a motor generator connected to the hydraulic pump; and a controller including an operation status detection unit that detects an operation status of the shovel, and an assist control unit that assists the operation status, the hydraulic shovel being configured to perform an excavating operation, a boom up swiveling operation, a dump operation and a boom down swiveling operation, wherein the operation status detection unit detects a start and an end of at least one of the excavating operation, the boom up swiveling operation, the dump operation and the boom down swiveling operation, and wherein, when the operation status detection unit detects the start of the one operation, the assist control unit starts assisting of the operation status by controlling to increase torque applied to an input shaft of the hydraulic pump by the motor generator to increase a horsepower of the hydraulic pump.

16. The hydraulic shovel according to claim 15, wherein, upon detecting a closing operation in which the arm is moved close to the slewing upper body, the controller controls to increase the horsepower of the hydraulic pump by increasing the maximum value of the horsepower of the hydraulic pump to become an assist time maximum value that is greater than an initial maximum value.

17. The hydraulic shovel according to claim 15, wherein the hydraulic pump is a variable capacity hydraulic pump capable of adjusting the maximum horsepower by changing the discharging amount of the high pressure oil by a regulator, and wherein the controller controls to increase the horsepower of the hydraulic pump by controlling the regulator to increase the amount of the high pressure oil of the hydraulic pump in the closing operation of the arm.

18. The hydraulic shovel according to claim 15, wherein the assist control unit terminates assisting of the operation status after the assisting of the operation status is started when another operation status different from the previous the operation status for which the assisting of the operation status is performed.

* * * * *